US007795794B2

(12) United States Patent
Moon et al.

(10) Patent No.: US 7,795,794 B2
(45) Date of Patent: Sep. 14, 2010

(54) ELECTRON EMISSION SOURCE, ELECTRON EMISSION DEVICE USING THE SAME, AND COMPOSITION FOR THE SAME

(75) Inventors: Hee-Sung Moon, Suwon-si (KR); Jae-Myung Kim, Suwon-si (KR); So-Ra Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 788 days.

(21) Appl. No.: 11/589,790

(22) Filed: Oct. 31, 2006

(65) Prior Publication Data

US 2007/0096618 A1 May 3, 2007

(30) Foreign Application Priority Data

Oct. 31, 2005 (KR) ..... 10-2005-0103433

(51) Int. Cl.
*H01J 1/62* (2006.01)

(52) U.S. Cl. ..... 313/495; 313/309

(58) Field of Classification Search ..... 313/495, 313/309, 310, 336, 351
See application file for complete search history.

(56) References Cited

U.S. PATENT DOCUMENTS 5,619,098 A * 4/1997 Toki et al. ..... 313/496
6,091,190 A * 7/2000 Chalamala et al. ..... 313/346 R

OTHER PUBLICATIONS

Kim, Tae Sik, et al, "Calculation of Field Enhancement Factor in CNT-Cathodes Dependence on Dielectric Constant of Bonding Materials", IMID'05 Digest, pp. 1092-1095 (&poster) (2005).

* cited by examiner

*Primary Examiner*—Vip Patel
(74) *Attorney, Agent, or Firm*—Lee & Morse, P.C.

(57) ABSTRACT

An electron emission device includes a first plate and a second plate spaced apart and facing each other, a first electrode having an electron emission source electrically coupled thereto, the electron emission source including a carbon-based material and a ferroelectric material, a second electrode disposed adjacent to the first electrode, and a phosphor layer disposed so as to receive electrons emitted by the electron emission source.

8 Claims, 3 Drawing Sheets

ELECTRON EMISSION SOURCE, ELECTRON EMISSION DEVICE USING THE SAME, AND COMPOSITION FOR THE SAME

BACKGROUND OF THE INVENTION

1. Field of the Invention

The present invention relates to an electron emission source, an electron emission device using the same, and a composition for the same.

More particularly, the present invention relates to an electron emission source that may exhibit enhanced electron emission performance, an electron emission device using the same, and a composition for the same.

2. Description of the Related Art

Typically, electron emission devices include an anode and a cathode, and an electron emission source that is electrically coupled to the cathode, e.g., by being disposed on the cathode. Of course, multiple electron emission sources, anodes and cathodes may be provided. A voltage may be applied across the anode and the cathode to form an electric field between the anode and the cathode, in order to cause the electron emission source to emit electrons. The electric field developed between the anode and the cathode may direct the emitted electrons to collide with a phosphor or other electroluminescent material, causing the material to emit light, e.g., visible light.

The electron emission source may include a carbon-based material.

Carbon-based materials, e.g., carbon nanotube (CNT), may exhibit various advantages such as good electron conductivity, high field enhancement effect, a low work function, good electron emitting characteristics, etc.

Furthermore, the use of a carbon-based material may allow the device to be operated at low voltage and manufactured in large area sizes, which may be desirable for a large display or other light-emitting device such as a lamp. Therefore, electron emission sources incorporating carbon-based materials may be desirable for electron emission devices.

Electron emission sources that include CNTs may be fabricated by growing CNTs on a substrate using a chemical vapor deposition (CVD) process, by a paste method that includes applying an electron emission source composition that includes CNTs to a substrate, etc. When the paste method is used, a manufacturing cost may be low, and electron emission sources may be formed across a large-area device.

When paste is prepared using CNTs, some silver powder, etc., may be added to the paste as filler. Adding silver powder may improve contact between CNTs and/or improve contact between the CNTs and the substrate. In addition, the CNT may be less separated from the substrate during use, and thus the electron emission property and lifetime of the CNT electron emission sources may be enhanced.

Despite the advantages of using a silver powder, when silver powder is added to the CNT as a filler, the permittivity of the CNT may be low. Additionally, it may be desirable to use a filler having a relatively low dielectric constant, because reducing the dielectric constant of the filler may improve the electron emission performance of the electron emission device.

SUMMARY OF THE INVENTION

The present invention is therefore directed to an electron emission source, an electron emission device using the same, and a composition for the same, which substantially overcome one or more of the problems due to the limitations and disadvantages of the related art.

It is therefore a feature of an embodiment of the present invention to provide an electron emission source that includes a carbon-based material and a ferroelectric material.

It is therefore another feature of an embodiment of the present invention to provide an electron emission source configured to emit electrons from a carbon-based material by field emission, and configured to emit thermal electrons from a ferroelectric material as a result of Joule heating.

It is therefore another feature of an embodiment of the present invention to provide an electron emission device including the electron emission source.

It is therefore yet another feature of an embodiment of the present invention to provide a composition for forming an electron emission source, the composition including a carbon-based material and a ferroelectric material.

At least one of the above and other features and advantages of the present invention may be realized by providing an electron emission device including a first plate and a second plate spaced apart and facing each other, a first electrode having an electron emission source electrically coupled thereto, the electron emission source including a carbon-based material and a ferroelectric material, a second electrode disposed adjacent to the first electrode, and a phosphor layer disposed so as to receive electrons emitted by the electron emission source.

The first plate may include the first electrode, the first electrode being a cathode, and the second plate may include the second electrode, the second electrode being an anode. The phosphor layer may correspond to the anode, such that electrons emitted by the electron emission source and attracted to the anode may collide with the phosphor layer.

The ferroelectric material may include $TiO_3$ and at least one of Ba, Sr, and Ca. The ferroelectric material may include at least one of $BaTiO_3$, $SrTiO_3$, and $CaTiO_3$. The electron emission source may include the ferroelectric material in an amount of about 10 to about 20 parts by weight, based on 1 part by weight of the carbon-based material. The carbon-based material may include at least one of carbon nanotube, graphite, diamond, fullerene, and silicon carbide.

The electron emission source may be configured to emit electrons from the carbon-based material through field emission upon application of a predetermined voltage to the first and second electrodes, and may be configured to emit thermal electrons from the ferroelectric material due to Joule heating caused by the field emission.

At least one of the above and other features and advantages of the present invention may also be realized by providing an electron emission source including a carbon-based material and a ferroelectric material.

The ferroelectric material may include $TiO_3$ and at least one of Ba, Sr, and Ca. The ferroelectric material may include at least one of $BaTiO_3$, $SrTiO_3$, and $CaTiO_3$. The ferroelectric material may be included in an amount of about 10 to about 20 parts by weight, based on 1 part by weight of the carbon-based material. The carbon-based material may include at least one of carbon nanotube, graphite, diamond, fullerene, and silicon carbide.

At least one of the above and other features and advantages of the present invention may further be realized by providing a composition for forming an electron emission source, including a carbon-based material, a vehicle, and a ferroelectric material.

The vehicle may include a resin component and a solvent component. The ferroelectric material may include $TiO_3$ and at least one of Ba, Sr, and Ca. The ferroelectric material may include at least one of $BaTiO_3$, $SrTiO_3$, and $CaTiO_3$. The ferroelectric material may be included in an amount of about 10 to about 20 parts by weight, based on 1 part by weight of the carbon-based material. The ferroelectric material may be a powder that is mixed with the carbon-based material and the vehicle, the powder having an average diameter of about 0.0001 μm to about 1 μm.

The composition may be a paste, and the vehicle is a material that may substantially dissipate upon heating the composition at a temperature of about 350° C. to about 500° C. for a predetermined amount of time.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
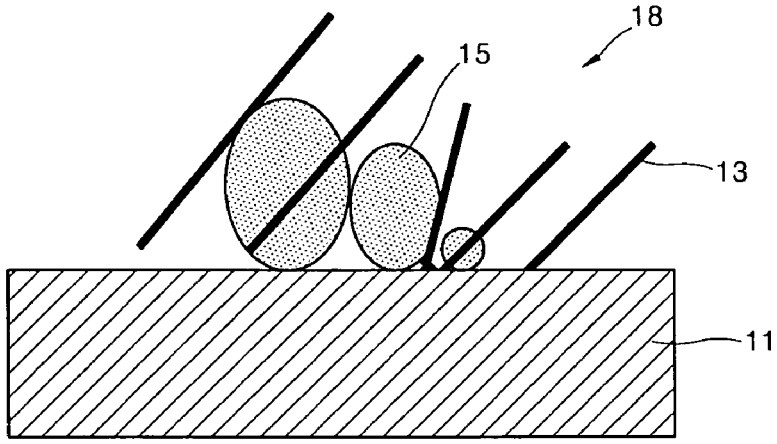
FIG. 1 illustrates a cross-sectional view of an electron emission source according to an embodiment of the present invention.

Korean Patent Application No. 10-2005-0103433, filed on Oct. 31, 2005, in the Korean Intellectual Property Office, and entitled: "Electron Emission Source and Electron Emission Device Using the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. It will also be understood that the term "phosphor" is intended to generally refer to a material that can generate visible light upon excitation by electrons that impinge thereon, and is not intended to be limited to materials that undergo light emission through any particular mechanism or over any particular time frame. Like reference numerals refer to like elements throughout.

Embodiments of the present invention may provide a composition suitable for forming an electron emission source that includes a carbon-based material, a ferroelectric material and a vehicle dispersed with the carbon-based material. The carbon-based material may include one or more of, e.g., CNT, graphite, diamond, fullerene, silicon carbide, etc. For convenience, the following description and the accompanying figures may specifically describe the use of CNT. However, it will be appreciated that this is simply for clarity of explanation, and embodiments of the present invention are not limited thereto.

Ferroelectric materials may exhibit a high permittivity and have been used as a dielectric layer in multi-layer ceramic condensers, etc. In addition, ferroelectric materials may emit thermal electrons at a high temperature. Accordingly, an electron emission source according to embodiments of the present invention may emit thermal electrons at a high temperature and may exhibit enhanced electron emission performance.

In particular, in an electron emission source, when a carbon-based material such as CNT emits electrons, the temperature at the end of the material may be raised to 1,500 K or more by Joule heating. Accordingly, an electron emission source according to embodiments of the present invention may exhibit field emission by the carbon-based material and thermal emission by the ferroelectric material. That is, the ferroelectric material may absorb heat that is produced by field emission and, as a result, emit thermal electrons. Therefore, an electron emission source according to embodiments of the present invention, and an electron emission device including the same, may exhibit enhanced electron emission. This may also reduce or eliminate deterioration of the carbon-based material in the electron emission source. Therefore, the reliability of an electron emission device according to embodiments of the present invention may be enhanced.

When an electric field is applied to a material, a dipole moment may be formed such that electric polarization occurs. However, for some materials, electric polarization spontaneously occurs even though an electric field is not applied thereto. Such a material is generally referred to as a ferroelectric, and the characteristic is referred to as ferroelectricity. Generally, ferroelectrics are electrically insulating dielectric materials. However, unlike some dielectric materials, the dielectric polarizations of ferroelectrics may not be proportional to the electric field. In particular, the relationship between polarization and electric field may be biphasic, and may exhibit electric hysteresis.

Ferroelectrics may be spontaneously polarized, and the polarization may be reversed by an electric field. Additionally, ferroelectrics may exhibit a phase transition phenomenon at Curie temperature. At less than the Curie temperature, the spontaneous polarization may be oriented in a particular direction due to the interaction between electric dipole, while the spontaneous polarization may be lost due to thermal fluctuation at a temperature greater than the Curie temperature.

FIG. 1 illustrates a cross-sectional view of an electron emission source according to an embodiment of the present invention. Referring to FIG. 1, an electron emission source 18 may include a carbon-based material 13 and a ferroelectric material 15 disposed on a substrate 11. In FIG. 1, the ferroelectric material 15 is illustrated as having different diameters. However, it will be appreciated that the diameters may be within a same range.

In an implementation, the electron emission source 18 may be formed by coating a composition for forming the electron emission source on the substrate 11, the composition including the carbon-based material 13 and the ferroelectric material 15. The composition may be developed and baked to prepare the electron emission source 18. The ferroelectric material 15 may be a ferroelectric powder used as a filler.

During operation of an electron emission device according to embodiments of the present invention, when the carbon-based material 13 emits electrons, the temperature at the end of the electron emission source 18 may be raised to 1,500 K or more. The ferroelectric material 15 may absorb heat caused by the field emission and emit thermal electrons.

Therefore, overall emission performance of the electron emission device may be enhanced.

Suitable ferroelectric materials may include, e.g., materials having $TiO_3$ and one or more of Ba, Sr, and Ca. The ferroelectric material may include, e.g., $(Ba, Sr)TiO_3$, one or more of $BaTiO_3$, $SrTiO_3$, and $CaTiO_3$, etc.

In an implementation, a paste may be prepared using a ferroelectric material such as a barium-titanium material, e.g., a material including $BaTiO_3$, etc., instead of an Ag powder. In an implementation, the ferroelectric material may be part of a filler, e.g., a nano-sized inorganic material, that provides enhanced adhesion and improves conductivity.

The composition for forming the electron emission source may include the ferroelectric material in an amount of about 10 to about 20 parts by weight, based on 1 part by weight of the carbon-based material. The use of less than about 10 parts by weight may decrease the emission performance. The use of more than about 20 parts by weight may affect the viscosity of the paste composition, which may be detrimental to the manufacturing process. An average diameter of the ferroelectric material may be, e.g., 1 μm or less. For example, the average diameter may be about 0.0001 μm to about 1 μm.

In an implementation, a composition for forming an electron emission source according to embodiments of the present invention may include a frit. The amount of the frit in the composition may be about 0.25 to about 10 parts by weight, based on 1 part by weight of the carbon-based material. The use of less than about 0.25 parts by weight of the frit may lower the adhesion of the electron emission source. The use of more than about 10 parts by weight of the frit may reduce the electron emission characteristics of the electron emission source.

As described above, the carbon-based material may include one or more of, e.g., CNT, graphite, diamond, fullerene, silicon carbide, etc.

Suitable carbon-based materials may exhibit one or more of high conductivity and good electron emission. Thus, during operation of the electron emission device, the carbon-based material may emit electrons to a phosphor layer, thereby exciting the phosphor. CNT may be a particularly suitable carbon-based material.

In an implementation, a composition for forming an electron emission source according to embodiments of the present invention may include a vehicle, which may be employed to adjust a printing property and viscosity of the composition. The vehicle may include, e.g., a resin component and a solvent component.

The resin component may include, e.g., one or more of a cellulose-based resin such as ethylcellulose, nitrocellulose, etc., an acryl-based resin such as polyester acrylate, epoxy acrylate, urethane acrylate, etc., a vinyl-based resin such as polyvinyl acetate, polyvinyl butyral, polyvinyl ether, etc., and other suitable resins. The resin component may be a photosensitive resin.

The solvent component may include, e.g., one or more of terpineol, butyl carbitol, butyl carbitol acetate, toluene, texanol, etc. Terpineol may be particularly suitable.

The composition may include the resin component in an amount of about 1 to about 5 parts by weight, based on 1 part by weight of the carbon-based material. In particular, the composition may include about 2 to about 3 parts by weight of the resin component. The composition may include the solvent component in amount of about 5 to about 15 parts by weight, based on 1 part by weight of the carbon-based material. In particular, the composition may include about 8 to about 12 parts by weight of the solvent component. The use of too little or too much vehicle may reduce the printing property and fluidity of the composition, or extend a drying time of the composition.

In an implementation, a composition for forming an electron emission source according to embodiments of the present invention may include one or more of a photosensitive resin and a photo initiator. The photosensitive resin may be included to allow for patterning the composition in order to form electron emission sources using lithographic techniques. The photo initiator may be included to initiate cross-linking of the photosensitive resin when the photosensitive resin is exposed to light.

The photosensitive resin may include one or more of an acrylate-based monomer, a benzophenone-based monomer, an acetophenone-based monomer, a thioxanthone-based monomer, etc.

Epoxy acrylate, polyester acrylate, 2,4-diethyloxanthone, 2,2-dimethoxy-2-phenylacetophenone, etc. may be particularly suitable.

The composition may include the photosensitive resin in an amount of about 3 to about 10 parts by weight, based on 1 part by weight of the carbon-based material. In particular, the composition may include about 5 to about 8 parts by weight of the photosensitive resin. The use of less than about 3 parts by weight of the photosensitive resin may result in a reduced sensitivity to light. The use of more than about 10 parts by weight may result in the photosensitive resin not being developed satisfactorily.

The photo initiator may include, e.g., benzophenone, etc. The composition may include the photo initiator in an amount of about 3 to about 10 parts by weight, based on 1 part by weight of the carbon-based material. In particular, the composition may include the photo initiator in an amount of about 5 to about 8 parts by weight. The use of less than about 3 parts by weight of the photo initiator may reduce the efficiency of cross-linking the photosensitive resin, which may be detrimental to pattern formation. The use of more than about 10 parts by weight of the photo initiator may increase manufacturing costs.

Hereinafter, additional details will be provided of methods of preparing an electron emission source using the composition according to embodiments of the present invention. The composition may include one or more of the components described above and may be printed on a substrate. As used herein, the term "substrate" is used to generally refer to a base for forming an electron emission source and is to be interpreted broadly. The substrate may include multiple layers, multiple portions, etc., as will be recognized by those of ordinary skill in the art. In an implementation, the substrate may be a cathode for an electron emission device having a gate electrode interposed between a cathode and an anode. In addition, the substrate may be an insulating layer that insulates a cathode and a gate electrode in an electron emission device having a gate electrode disposed below a cathode.

The printing of the composition on the substrate may be different depending on whether or not the composition includes a photosensitive resin. If the composition does not include the photosensitive resin, a photoresist film pattern may be formed using a photoresist film, and then the composition may be printed using the photoresist film pattern. If the composition includes the photosensitive resin, an additional photoresist pattern may be unnecessary. For example, the composition including the photosensitive resin may be coated on the substrate, and may then be exposed and developed to form an electron emission source in a desired region. The composition may be a paste that includes a frit material and a photosensitive resin, wherein the composition can be patterned by exposure to light.

The printed composition may be heat treated and/or sintered, e.g., under an atmosphere of nitrogen gas, or oxygen and nitrogen combined, which may enhance the adhesion between the carbon-based material and the substrate. Heat treatment and/or sintering may enhance the durability of the device by volatilizing and removing the vehicle, melting and solidifying other inorganic binders, etc.

The temperature(s) used for the heat treating and/or sintering processes may take into consideration the volatilizing temperature of a vehicle included in the composition as well as the time required for volatilizing the vehicle. The temperature may be about 350° C. to about 500° C., e.g., 450° C. The use of temperatures lower than about 350° C. may result in insufficient volatilization. The use of temperatures greater than about 500° C. may damage some substrates.

In an implementation, the heat treated and/or sintered resultant may be activated. During activation, nano-sized inorganic materials may be exposed on a surface of the electron emission source, a vertical orientation of the nano-sized inorganic materials may be adjusted, etc. For example, a solution that hardens to a film may be applied to the resultant and then heat treated and/or baked, after which it may be detached from the surface of the electron emission source. The solution may include, e.g., a polyimide-based polymer. In another example, an adhesive may be applied to the resultant, e.g., by applying the adhesive to a surface of a roller that is operated with a predetermined driving source, such that a surface of the resultant is pressed by the roller with a predetermined pressure.

Figure 2:
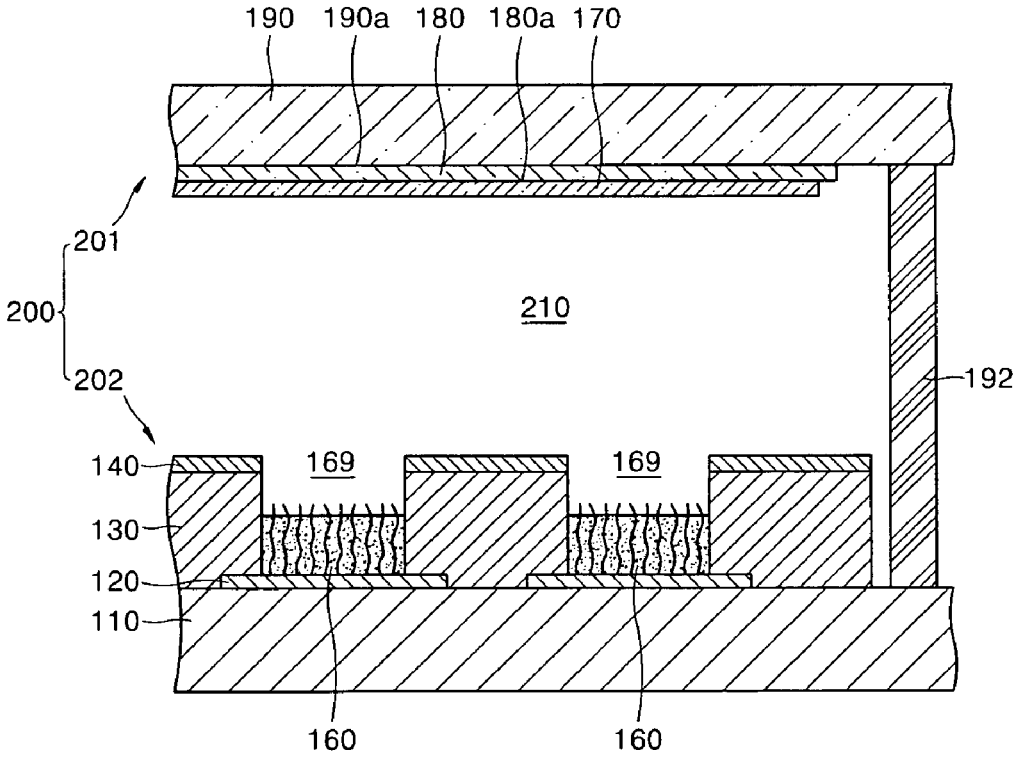
FIG. 2 illustrates a schematic cross-sectional view of an electron emission device according to an embodiment of the present invention.

FIG. 2 illustrates a schematic cross-sectional view of an electron emission device according to an embodiment of the present invention. Referring to FIG. 2, the device may be a triode electron emission device. However, it will be appreciated that embodiments of the present invention are not limited thereto. The electron emission device 200 may include an upper plate 201 and a lower plate 202. The upper plate 201 may include an upper substrate 190, an anode 180 disposed on a lower surface 190*a* of the upper substrate 190, and a phosphor layer 170 disposed on a lower surface 180*a* of the anode 180.

The lower plate 202 may include a lower substrate 110 disposed facing and at a predetermined distance from the upper substrate 190. The lower plate 202 may include a cathode 120 disposed on the lower substrate 110 and arranged in, e.g., a stripe pattern, a gate electrode 140 arranged in a stripe pattern so as to cross the cathode 120, and an insulating layer 130 interposed between the gate electrode 140 and the cathode 120. The lower plate 202 may further include an electron emission source hole 169 formed in a part of the insulating layer 130 and the gate electrode 140, and an electron emission source 160 disposed corresponding to the electron emission source hole 169. The electron emission source 160 may be electrically connected to the cathode 120 and may have a height lower than the gate electrode 140. The electron emission source may be formed as described above. Accordingly, a detailed description thereof will not be repeated.

The region between the upper plate 201 and the lower plate 202 may be maintained at a predetermined level of vacuum, i.e., a pressure lower than atmospheric pressure. A spacer 192 may be interposed between the upper plate 201 and the lower plate 202 to provide support therefor. The spacer 192 may additionally divide an emission space 210.

During operation of the device, the anode 180 may have a high voltage applied thereto, in order to accelerate electrons emitted from the electron emission source 160 and cause the emitted electrons to collide with the phosphor layer 170 at high speed. The collisions of the emitted electrons with a phosphor material of the phosphor layer 170 may excite the phosphor, which may emit visible light upon relaxation to a lower energy level.

The gate electrode 140 may allow electrons to be easily emitted from the electron emission source 160. The insulating layer 130 may define the electron emission source hole 169 and insulate the electron emission source 160 from the gate electrode 140.

As described above, embodiments of the present invention are not limited to the triode electron emission device illustrated in FIG. 2. Embodiments of the present invention may include, e.g., a diode structure or other electron emission device structures. For example, the gate electrode may be disposed below the cathode, a grid or mesh may be provided to prevent a gate electrode and/or a cathode from being damaged by an arc generated due to electric discharge, and to assist in focusing of electrons emitted from an electron emission source, etc. Moreover, while electrode structures have been particularly described as striped and/or crossing, other arrangements may be suitable, and the structure of the electron emission device may be configured for any of a number of light emitting devices, e.g., displays, lamps such as backlight units, etc.

The present invention will now be described in greater detail with reference to the following examples, which are for illustrative purposes only and are not intended to limit the scope of the invention.

EXAMPLES

Example 1

1 g of CNT powder (MWNT, CNI Technologies), 1 g of frit (8000L, Shinheung Ceramic Industry Co., Ltd.), 5 g of polyester acrylate, 5 g of photosensitive resin (trimethylolpropane triacrylate, Aldrich Co., Ltd.), and 5 g of photo initiator (HS-188, Dongyang Ink Co., Ltd.) were added to 40 g of terpineol, and then 2 g of $BaTiO_3$ was added thereto, and the mixture was stirred to prepare a composition for forming an electron emission source.

The composition was printed on a region of a substrate in which an electron emission source was to be disposed. The substrate included a Cr gate electrode, an insulating film and an indium tin oxide (ITO) electrode.

Then, the printed composition was exposed to light using a pattern mask and parallel exposure equipment with an exposure energy of 2,000 mJ/cm$^2$. The exposed resultant was developed using acetone and sintered at 450° C. under oxygen-nitrogen mixed gas atmosphere, having an oxygen concentration of about 1,000 ppm, so as to obtain an electron emission source.

Thereafter, a second substrate having a phosphor layer and an ITO anode electrode was disposed facing the first substrate, on which the electron emission source was formed. A spacer was disposed between the two substrates in order to maintain a cell gap between the substrates in the final electron emission device.

Comparative Example 1

An electron emission source-forming composition was prepared in the same manner as in Example 1, except that $BaTiO_3$ was not used, and an electron emission device was completed by the same process as above.

Evaluation and Results

Current densities of the electron emission sources according to Example 1 and Comparative Example 1 were measured using a pulse power source and an ammeter.

Figure 3:
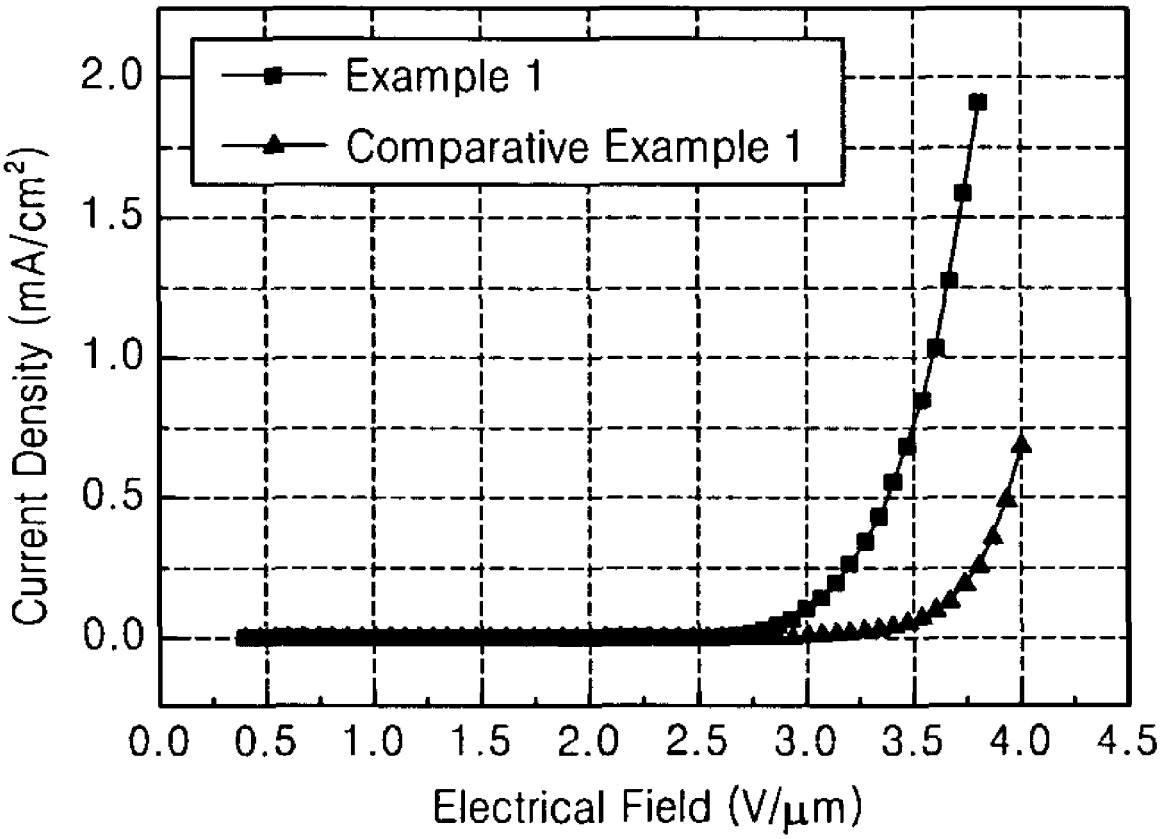
FIG. 3 illustrates a graph showing current density of an electron emission source according to Example 1 and Comparative Example 1.

FIG. 3 illustrates a graph showing current density of an electron emission source according to Example 1 and Comparative Example 1.

Referring to FIG. 3, it is apparent that a current density characteristic of the electron emission source of Example 1, in which $BaTiO_3$ was included, was superior to that of the electron emission source of Comparative Example 1, in which $BaTiO_3$ was not used.

Figure 4A:
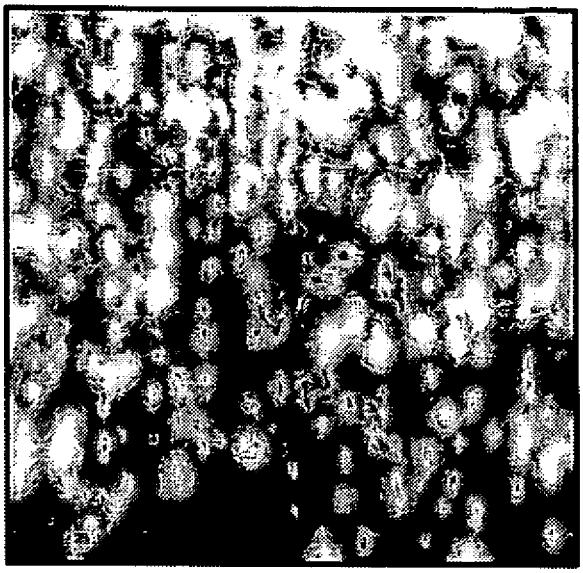
FIGS. 4A and 4B illustrate images of an electron emission characteristic of an electron emission device according to Example 1 and Comparative Example 1.
Figure 4B:
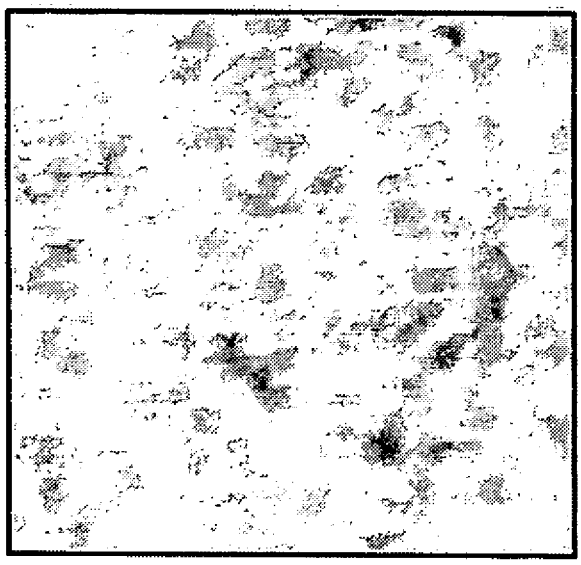

FIGS. 4A and 4B illustrate images of an electron emission characteristic of an electron emission device according to Example 1 and Comparative Example 1, respectively. Referring to FIGS. 4A and 4B, it is apparent that the electron emission device of Example 1, in which $BaTiO_3$ was included, is uniform in comparison with that of Comparative Example 2, in which $BaTiO_3$ was not used. Therefore, embodiments of the present invention may provide an electron emission device exhibiting enhanced electric emission characteristics.

When an electron emission source is prepared according to embodiments of the present invention, e.g., using the composition for forming the electron emission source having a ferroelectric powder as filler, the electron emission source may exhibit enhanced electron emission performance.

In particular, the ferroelectric material may absorb heat produced by field emission through Joule heating. The absorbed heat may induce the ferroelectric material to emit thermal electrons. Accordingly, it may be possible to extend the lifespan of an electron emission source having CNTs. Therefore, the reliability of a device employing the electron emission source may be enhanced.

An electron emission source prepared as described above may include a carbon-based material and a ferroelectric material, and may be used in electron emission devices such as display devices, backlight units, etc.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission device, comprising:

a first plate and a second plate spaced apart and facing each other;

a first electrode having an electron emission source electrically coupled thereto, the electron emission source including a carbon-based material and a ferroelectric material;

a second electrode disposed adjacent to the first electrode; and a phosphor layer disposed so as to receive electrons emitted by the electron emission source.

2. The electron emission device as claimed in claim 1, wherein:

the first plate includes the first electrode, the first electrode being a cathode, and the second plate includes the second electrode, the second electrode being an anode.

3. The electron emission device as claimed in claim 2, wherein the phosphor layer corresponds to the anode, such that electrons emitted by the electron emission source and attracted to the anode collide with the phosphor layer.

4. The electron emission device as claimed in claim 1, wherein the carbon-based material includes at least one of carbon nanotube, graphite, diamond, fullerene, and silicon carbide.

5. The electron emission device as claimed in claim 4, wherein the ferroelectric material includes at least one of $BaTiO_3$, $SrTiO_3$, and $CaTiO_3$.

6. The electron emission device as claimed in claim 5, wherein the electron emission source includes the ferroelectric material in an amount of about 10 to about 20 parts by weight, based on 1 part by weight of the carbon-based material.

7. The electron emission device as claimed in claim 4, wherein the ferroelectric material includes $TiO_3$ and at least one of Ba, Sr, and Ca.

8. The electron emission device as claimed in claim 1, wherein the electron emission source emits electrons from the carbon-based material through field emission upon application of a predetermined voltage to the first and second electrodes, and emits thermal electrons from the ferroelectric material due to Joule heating caused by the field emission.

* * * * *